United States Patent [19]

Sinclair

[11] Patent Number: 4,513,973

[45] Date of Patent: Apr. 30, 1985

[54] ELECTRONIC COMPLETING THE SQUARE GAME

[76] Inventor: Iain Sinclair, Willow House/Hildersham, Cambridge, England

[21] Appl. No.: 545,675

[22] Filed: Oct. 25, 1983

[30] Foreign Application Priority Data

Oct. 27, 1982 [GB] United Kingdom ..... 8230613

[51] Int. Cl.[3] ..... A63F 3/00

[52] U.S. Cl. ..... 273/237; 273/267; 273/153 R

[58] Field of Search ..... 273/237, 267, 153

[56] References Cited

U.S. PATENT DOCUMENTS

| | | | |
|---|---|---|---|
| 3,863,926 | 2/1975 | White et al. | 273/267 |
| 4,036,500 | 7/1977 | Kiernan | 273/237 |
| 4,228,596 | 10/1980 | Daniel | 273/237 |
| 4,244,635 | 1/1981 | Sasaki et al. | 273/237 |
| 4,277,066 | 7/1981 | Hough | 273/267 |

*Primary Examiner*—Richard C. Pinkham
*Assistant Examiner*—Vincent A. Mosconi
*Attorney, Agent, or Firm*—Trexler, Bushnell & Wolters, Ltd.

[57] ABSTRACT

A pocket-sized electronic board game is disclosed. The apparatus for playing the game comprises a casing which serves also as the playing surface, through which project a plurality of push-buttons for actuating the keys in selected positions. A membrane-type key board may alternatively be used. The push-buttons and keys are arranged in a plurality of rows and columns with elongate light sources extending parallel to the rows of columns and between adjacent pairs of row-wise or column-wise keys. The electronic circuit within the casing acts to detect depression of two adjacent keys in any row or column and operates when such detection is made to cause the light source between the two actuated keys to illuminate and remain illuminated until the end of the game so that by depressing pairs of keys in turn players can "claim" sides of the squares constituted by the light sources. An embodiment including a microprocessor with a programme for providing moves representing those made by an opponent is also disclosed so that the apparatus can be used by one player.

12 Claims, 6 Drawing Figures

ELECTRONIC COMPLETING THE SQUARE GAME

BACKGROUND OF THE INVENTION

Electronic games are becoming increasingly popular, particularly electronic games which can be used by only one player and which act either automatically, or in accordance with a predetermined programme, to supply the moves in the game representing a second player. Known in such art are electronic chess and draughts games where a processor indicates by illuminating a selected position the move which the processor intends to make, and the player in opposition to the processor moves pieces over a board similar to a conventional chess board, but having electrical contacts which are completed by the player's pieces to indicate the positions of the pieces thus moved.

OBJECTS OF THE INVENTION

The primary object of the present invention is to provide electronic game apparatus which can be used by one or two players.

Another object of the present invention is to provide electronic game apparatus having a plurality of push-buttons which can be depressed during play to cause illumination of secret or hidden light sources concealed under a transparent or translucent screen.

A further object of the present invention is to provide a pocket-sized electronic game apparatus having means for indicating on the playing surface which player is winning or has won the game in progress.

SUMMARY OF THE INVENTION

The invention achieves the stated objects by the provision of electronic game apparatus comprising a playing surface, a plurality of manually operable switch means arranged in a matrix of rows and columns on said playing surface, a plurality of illuminable indicator means spaced over the playing surface with one between each pair of adjacent switch means in the rows and columns thereof, and an electronic circuit operable in response to the actuation of any two adjacent switch means to cause said illuminable indicator means located between said two adjacent switch means to illuminate.

The game which can be played with the game apparatus of the present invention is one involving skill only and there is no element of chance or luck. The selection of the pairs of switch means to be actuated uniquely identifies a player's move and constraints on selection of said switch means are limited only to the previous moves which have been made and relies solely on the skill and judgement of the player.

The switch means preferably have push-button operating members projecting through said playing surface with said illuminable indicators being located beneath said playing surface so as to be concealed thereby except when illuminated. As play progresses, therefore, the matrix of push-button switches visible on the playing surface are gradually supplemented by the illumination of said illuminable indicators which, in a preferred embodiment of the invention, are formed as elongate elements substantially extending for the whole distance between adjacent switch means in a row or column.

Preferably, therefore, said illuminable indicators are in the form of line segments aligned with the rows or columns of said switch means and said electronic circuit includes detector means sensitive to coincident actuation of row-wise or column-wise pairs of said switch means operating, when such coincident actuation is detected, to cause illumination of a said line segment illuminable indicator spanned by the actuated said switch means.

The playing surface may be transparent, although preferably it is translucent, and the line segment illuminable indicators are located beneath the playing surface on a support carried by a casing body of the apparatus, the casing body and playing surface constituting two casing halves enclosing the apparatus.

In an embodiment including a computer or microprocessor for providing alternate moves to represent an opponent, the electronic circuit preferably includes means for illuminating selected said illuminable indicators independently of operation of said manually operable switch means. Such an electronic processor or computer preferably includes a Read Only Memory containing a programme of moves to be represented by the processor, a Random Access Memory for storing information representing the moves made during the course of a game in progress, encoder means operating to encode signals generated by actuation of said switches into a form suitable for said processor, and decoder means operating to decode output data signals from the processor to energise selected lines for illumination of said illuminable indicator means identified by said data signals.

In such an embodiment it is necessary to be able to identify which of the squares of line segments illuminated have been illuminated as a result of actuation of the switch means by a player, and which of the line segments have been illuminated by the computer. This may be achieved in one of a number of ways. For example, each line segment illuminable indicator may be formed as two elements having different colours, one colour being illuminated by actuation of the push-buttons and the other being illuminated by the computer. Alternatively, the line segment illuminable indicators may be all the same colour and otherwise indistinguishable, with the programme in the memory retaining information as to whether the computer or the player depressed the appropriate button to cause illumination of that line segment, and there may be provided secondary illuminable indicator means located at the intersections of diagonal lines joining said switch means of said rows and columns, and said electronic circuit may operate to illuminate said secondary indicator means in a first manner when all the immediately surrounding line segment illuminable indicators in rows and columns in each side thereof have all been illuminated to form a square by the player acting on said switch means, and in a second manner when said line segments of said square have all been illuminated by said processor. The first manner of illumination may be constant illumination and the second manner may be flashing or intermittent illumination.

Other features and advantages of the present invention will become more readily apparent from a study of the following description made with reference to the accompanying drawings presented merely by way of non-limitative example.

DESCRIPTION OF THE PREFERRED EMBODIMENTS

Figure 1:
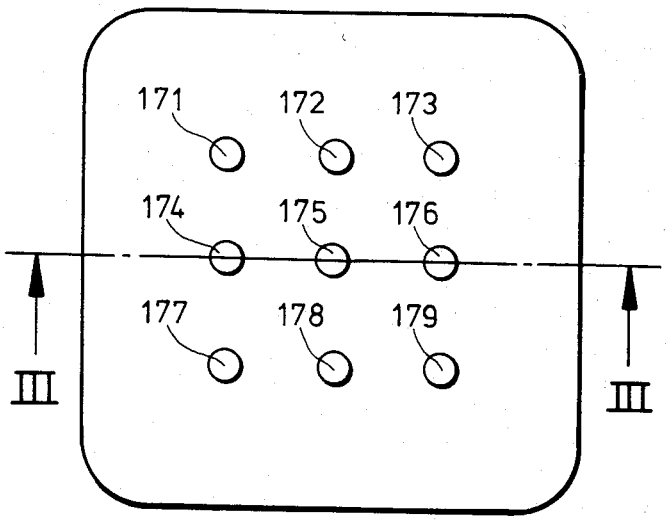
FIG. 1 is a front view of a simplified embodiment of the invention illustrating the playing surface thereof.
Figure 2:
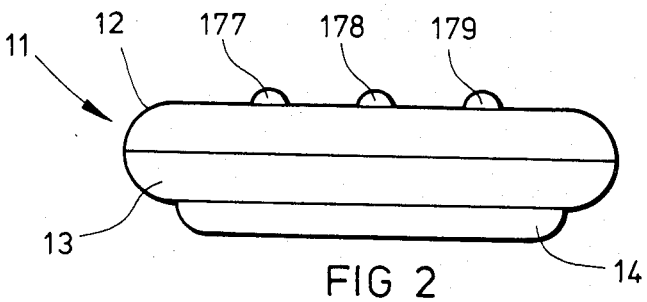
FIG. 2 is a side view of the embodiment of FIG. 1.
Figure 3:
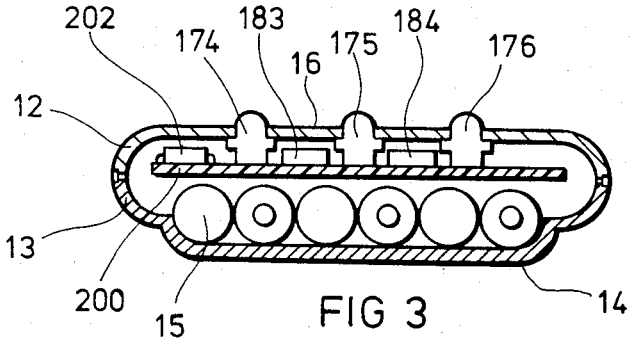
FIG. 3 is a sectional view taken on the line III—III of FIG. 1.

Referring to FIGS. 1 to 4, the embodiment illustrated comprises a casing generally indicated by the reference numeral 11 having an upper casing half 12 and a lower casing half 13. The upper casing half 12 is made of translucent material and is formed as a generally rectangular plate with a peripheral flange by which it is joined to the lower casing half 13 which is of similar shape with an additional base portion 14 constituting a housing for a plurality of dry cell batteries 15 which drive the electronic circuit housed within the casing 11 and described in greater detail below.

The translucent upper casing half 12 has a planar main portion 16 constituting the playing surface having a plurality of holes arranged in a matrix of rows and columns through which project the manually operable ends of a plurality of push-button switches identified by the reference numerals 171–179 inclusive. In the present embodiment nine such push-button switches are shown in a matrix of three rows and three columns, although it will be appreciated that this is a simplification for the purpose of explanation and practical embodiments may have a greater number of rows and columns of such push-buttons. The nine push-buttons shown represent the smallest number which can be provided but there is no upper limit on the number of push-buttons which may be provided except that placed by constraints of convenient handling of the apparatus. For example, if the push-buttons 171, 172, etc were placed one half of one inch apart, which is a convenient spacing for manual operation, then a four inch square playing surface may conveniently contain 64 push-buttons in rows and columns of 8 such push-buttons. Other dimensions may be chosen by the man skilled in the art to suit the particular requirements of any given manufacturing technique or intended market.

Figure 5:
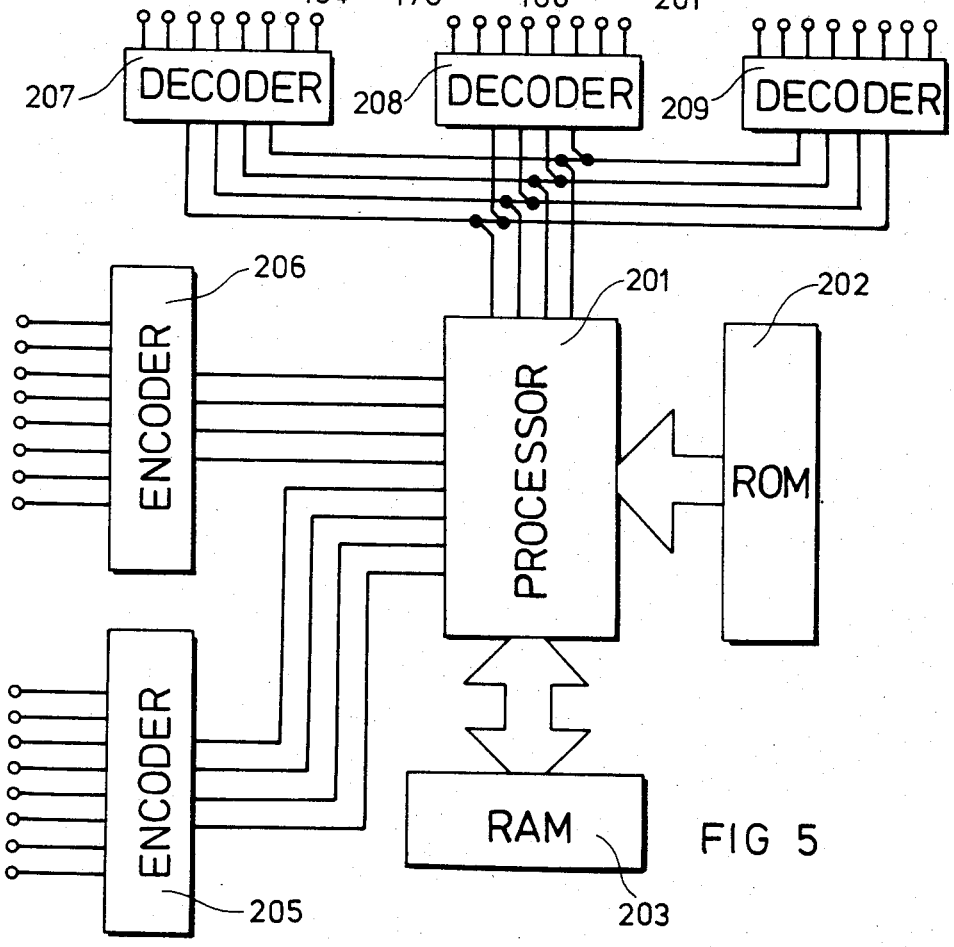
FIG. 5 is a block schematic diagram of the electronic circuit for controlling the apparatus illustrated in FIGS. 1 to 4.

Under the translucent playing surface 16 are a plurality of light emitting diodes constituting line segment line sources and arranged in orientations parallel to the rows or parallel to the columns of said push-buttons. The light emitting diodes in said rows are identified by the reference numerals 181, 182, 183, 184, 185, 186 and the light emitting diodes in said columns are identified by the reference numerals 191, 192, 193, 194, 195, 196. The push-button switches 171–179 and the light emitting diodes 181–186; 191–196 are all mounted on a printed circuit support board 200 which also carries electronic components comprising a microprocessor 201, a Read Only Memory 202, a Random Access Memory 203 and a set of encoder/decoder units 205–209, shown in FIG. 5, and generally indicated by the single rectangle 204. A switch (not shown) on the side of the casing 11 effects connection between the dry cell batteries 15 and the electronic circuit to energise the game apparatus. Then, by pressing two adjacent push-button switches in a row or a column thereof, illumination of the line segment light source constituted by the light emitting diode between the two depressed switches will be effected. For example, if the push-buttons 171 and 174 are depressed then the LED 191 will be energised to illuminate and will thus show through the translucent screen 16. After two buttons have been depressed the processor acts to generate, under the control of the Read Only Memory 202, a signal causing energisation of another of the light emitting diodes, and then awaits depression of a further two push-buttons before making another move. Data on the push-buttons selected for depression is transferred by the processor 201 into the Random Access Memory 203 and stored therein during the course of a game. Four further light emitting diodes 210, 211, 212 and 213 are provided each at the centre of a square defined by four adjacent push-button switches. These light emitting diodes are illuminated by the processor 201 when all four push-button switches have been depressed by the player or when the associated four line segment light emitting diodes have been energised by the processor. If the player has depressed all four push-buttons, the diode 210–213 is illuminated steadily, whereas if the four line segment light emitting diodes have been illuminated by the processor the diodes 210, 213 are illuminated intermittently to flash. Thus, when playing the game, the player depresses the pairs of push-buttons to illuminate the line segment light emitting diode between them in an attempt to "claim" squares before the processor can do so.

Figure 6:
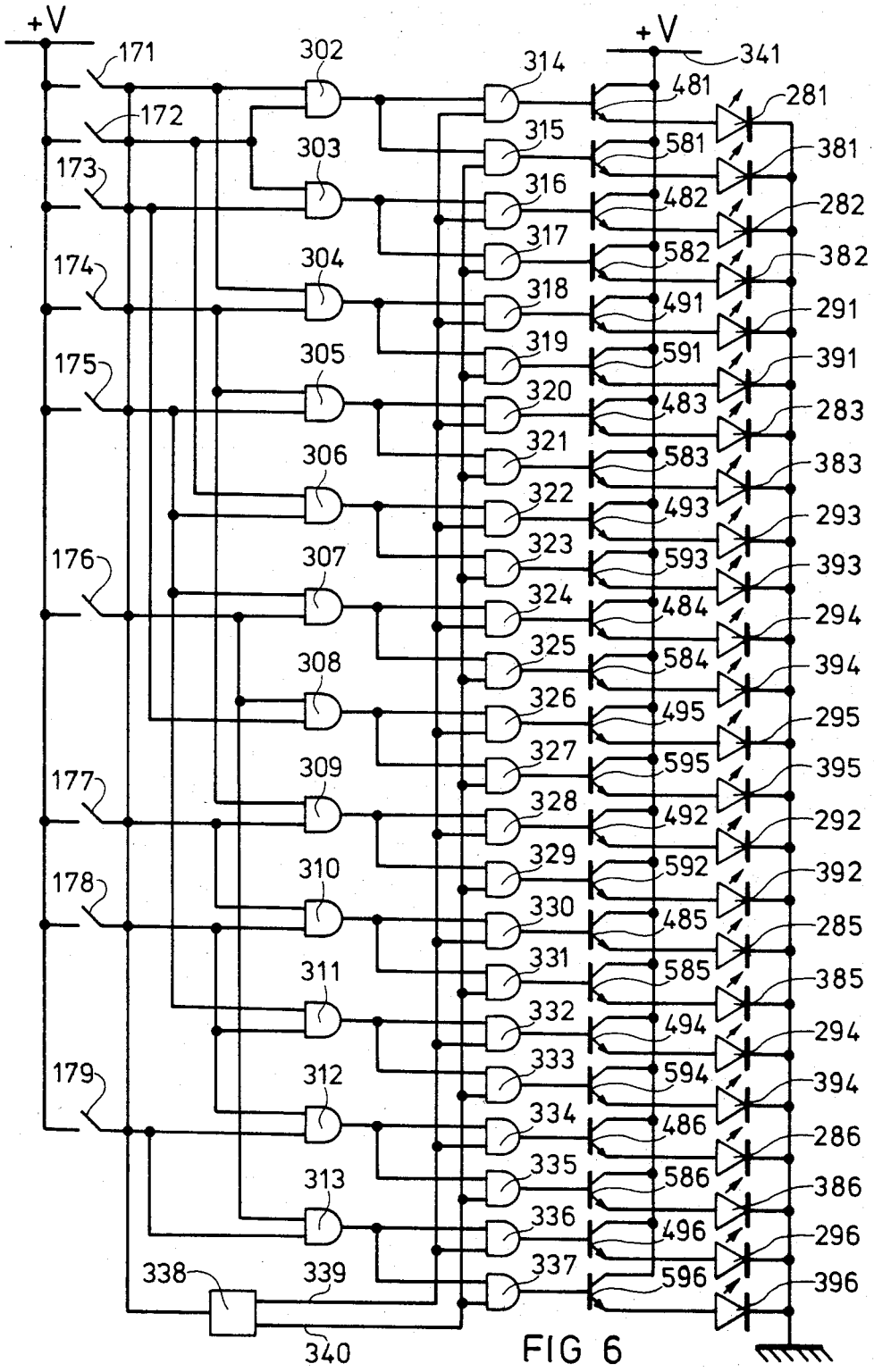
FIG. 6 is a logic diagram illustrating the basic components of an alternative embodiment of the invention.

FIG. 6 illustrates the logic circuit of an embodiment having the same format as the embodiment of FIGS. 1 to 4, but which is set up for two players to operate alternately in a competitive game. In the embodiment of FIG. 6 the items which are the same as the embodiment of FIGS. 1 to 4 have been identified with the same reference numerals. Thus, for example, the nine push-button switches 171–179 are indicated as switches between a logic plus 5 volts supply line 301 and the inputs of 12 AND gates 302–313 respectively. Each adjacent pair of push-button switches, for example the switches 171, 172, are connected to inputs of an associated AND gate from the set 302–313 so that coincident depression of the two switches causes an output signal to be generated by the AND gate link thereto. The output of the AND gate 302 is fed as one input to each of two further AND gates 314, 315. The other input of the AND gate 314 is supplied from a first output of a bistable circuit 338 and the other input of the AND gate 315 is supplied by the other output of the bistable circuit 338. The input of the bistable circuit 316 is connected to all of the push-button switches 171–179 so as to receive a signal input whenever any switch is depressed to cause a change of state at the outputs thereof. The output lines from the bistable circuit 316 are identified by the reference numerals 339 and 340 respectively.

In this embodiment each of the light emitting diodes 181–186 and 191–196 is replaced by two light emitting diodes correspondingly identified by the same reference numerals raised by 100 and 200 respectively. Thus, the light emitting diode 181 is replaced by two light emitting diodes 281, 381; the light emitting diode 182 is replaced by two light emitting diodes 282, 382 etc. All the light emitting diodes starting with the reference numeral 2 emit green light and all those starting with the reference numeral 3 emit red light or have green and red filters respectively.

The light emitting diodes are driven by respective transistors identified by the same reference numerals raised to 400 and 500 respectively so that the diode 281 is driven by a transistor 481 and the diode 381 is driven by a transistor 581.

The switches 172 and 173 are connected to inputs of an AND gate 303 the output of which feeds two AND gates 316, 317 also enabled, respectively, by the output lines 339, 340 of the bistable circuit 338. The output from the AND gate 316 is connected to the base of a transistor 482 and the output from the AND gate 317 is connected to the base of transistor 582. The emitters of the two transistors 482, 582 are connected to a positive supply line 341 and the respective emitters of the transistors 482, 582 are connected to respective green and red light emitting diodes 282, 382.

Figure 4:
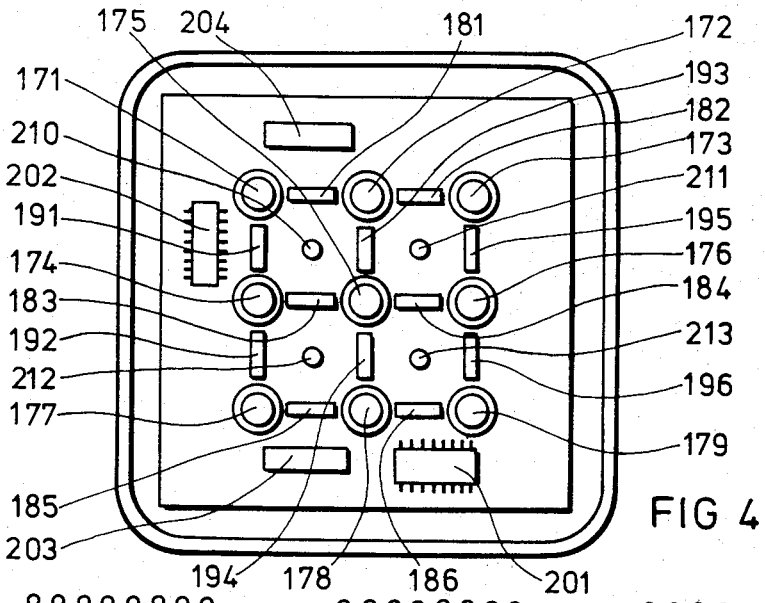
FIG. 4 is a view of the embodiment illustrated in FIGS. 1 to 3 with the upper casing half removed.

The switches 173 and 174 are not connected to an AND gate since, as will be seen with reference to FIG. 4 these are not adjacent to one another in either a row or a column. Instead, the switch 174 is gated with the switch 171 as inputs to an AND gate 304, the outputs of which are connected as inputs to two AND gates 318, 319, again enabled by the outputs 339, 340 of the bistable circuit 338, and in turn controlling transistors 491, 591 driving light emitting diodes 291, 391 which are located in the position of the line segment light source 191 of FIG. 4.

The switches 174, 175 are gated together at an AND gate 305 the output from which controls two further AND gates 320, 321 energising transistors 483, 583 driving light emitting diodes 283, 383 respectively.

The switch contacts 172 and 175 are gated together at an AND gate 306 the output from which is connected as an input to each of two further AND gates, 322, 323 enabled by the outputs 339, 340 of the bistable circuit 338 and in turn controlling two transistors 493, 593 driving respective light emitting diodes 293, 393. The remainder of the circuit follows the same scheme and will not be described in detail any further.

In operation, when the ON/OFF switch (not shown) is turned on to energise the supply line to the switches 171, 179 the first player selects which two row-wise or column-wise adjacent push-buttons he wishes to depress and, assuming that the bistable circuit 338 is in the state with the output line 339 in the "one" state and the output 340 in the "zero" state, then depression of any two adjacent push-buttons, for example the push-button 176 and the push-button 175 will cause the gate 307 to generate a "one" signal output which is fed to the inputs of the two AND gates 324, 325. Depression of the push-buttons 175, 176 will also feed a signal on the input line to the bistable circuit 338 causing its state to change and apply a "one" signal on the line 340 which is connected to the input of the AND gate 325. This AND gate therefore applies a control signal to the base of the transistor 584 turning this transistor on and energising the light emitting diode 384. A latching circuit (not shown) associated with each of the transistors ensures that once switched on they will remain on until the end of the game so the light emitting diode 384, in this case a red diode, is illuminated in the space occupied in FIG. 4 by the line segment diode 184 between the switches 175, 176. The next player now selects which pair of push-buttons he intends to press. Let us assume that he elects to press the push-buttons 178 and 179. Upon depressing one of these, for example, the push-button 178 the bistable circuit 338 flips to its other state producing a "one" output on the line 339 and a "zero" output on the line 340. When the push-button 179 is depressed it does not cause the bistable circuit 338 to change state since the continued depression of the push-button 178 means that no additional signal is supplied to the bistable circuit 338. The two push-buttons 178, 179 are gated as inputs to the AND gate 312 which thus produces a "one" output to the AND gates 334, 335. Since the line 340 now has a "zero" output on it from the bistable 338, the AND gate 335 will remain unchanged and the AND gate 334 will produce a "one" output as a result of the enabling "one" signal on the line 339 from the bistable circuit 338 and the "one" signal from the AND gate 312. This turns on the transistor 486 to energise the light emitting diode 286 which, this time, is the green 200 series diode in place of the line segment diode 186 in the embodiment of FIG. 4. The game then continues with each alternate player actuating the switches and causing the bistable 338 to change state enabling the upper or lower AND gate of each respective pair in turn so that either the red series or green series light emitting diodes are energised respectively. At the end of the game the squares of red or green bars are counted to determine which player is the winner.

What is claimed is:

1. Electronic game apparatus comprising:

a playing surface;

a plurality of manually operable switch means arranged in a matrix of rows and columns on said playing surface, a plurality of illuminable indicator means spaced over said playing surface with one between each pair of adjacent said switch means in said rows and columns thereof, and electronic circuit means operable in response to the actuation of any two adjacent said switch means to cause illumination of said illuminable indicator means located between said two adjacent switch means.

2. The electronic game apparatus of claim 1, wherein said manually operable switch means have push-button operating members projecting through said playing surface and said illuminable indicators are located beneath said playing surface so as to be concealed thereby except when illuminated.

3. The electronic game apparatus of claim 1, wherein said illuminable indicators are in the form of line segments aligned with the rows or the columns of said switch means and said electronic circuit includes detector means sensitive to coincident actuation of row-wise or column-wise pairs of said switch means and operating, when such coincident actuation is detected, to cause illumination of a line segment illuminable indicator at each end having the actuated switch means thereof.

4. The electronic game apparatus of claim 3, wherein said playing surface is either translucent or transparent and said line segment illuminable indicators are located beneath said playing surface on a support carried by a casing body of said apparatus, said casing body and said playing surface constituting two casing halves enclosing said apparatus.

5. The electronic game apparatus of claim 1, wherein said electronic circuit includes means for illuminating selected said illuminable indicators independently of operation of said manually operable switch means whereby to represent the moves of an opponent playing in opposition to the player operating said manually operable switch means.

6. The electronic game apparatus of claim 5, wherein said electronic circuit includes electronic processor means, a Read Only Memory containing a programme of moves to be represented by the processor, a Random Access Memory for storing information representing the moves made during the course of a game in progress, encoder means operating to encode signals operated by actuation of said switches into a form suitable for said processor means, and decoder means operating to decode output data signals from said processor to provide signals on selected lines to energise said illuminable indicator means identified by said data signals.

7. The electronic game apparatus of claim 6, further including secondary illuminable indicator means located at the intersections of diagonal lines joining said switch means of said rows and columns, said electronic circuit operating to illuminate said secondary indicator means in a first manner when all the immediately surrounding line segments illuminable indicators in rows and columns on each side thereof have all been illuminated to form a square by the player acting on said switch means and in a second manner when said line segments of said square have all been illuminated by said processor.

8. The electronic game apparatus of claim 7, wherein said first manner is constant illumination and said second manner is flashing intermittent illumination.

9. The electronic game apparatus of claim 1, wherein said illuminable indicators include a first element illuminated upon actuation by a first player and a second element illuminated upon actuation by a second player operating on said switch means alternately with said first player.

10. The electronic game of claim 9, wherein said electronic circuit includes bistable means acting to enable illumination of said first element of said indicators alternately with enablement of illumination of said second element of said indicators upon successive operation of said switch means.

11. The electronic game apparatus of claim 9 wherein said first and second elements of said illuminable indicators have different colours whereby to indicate which player caused energisation thereof.

12. The electronic game apparatus of claim 9, wherein said electronic circuit includes coincidence detector means operating to detect coincidence of actuation of adjacent row-wise or column-wise pairs of said switch means.

* * * * *